US006887012B1

(12) United States Patent
Zappe

(10) Patent No.: US 6,887,012 B1
(45) **Date of Patent: *May 3, 2005**

(54) COVER APPARATUS FOR AN ACCESS PIPE OPENING

(76) Inventor: Raymond Zappe, 4609 E. Desert View Dr., Phoenix, AZ (US) 85044

( * ) Notice: Subject to any disclaimer, the term of this patent is extended or adjusted under 35 U.S.C. 154(b) by 4 days.

This patent is subject to a terminal disclaimer.

(21) Appl. No.: 10/365,852

(22) Filed: Feb. 14, 2003

Related U.S. Application Data

(63) Continuation-in-part of application No. 10/091,511, filed on Mar. 7, 2002, now Pat. No. 6,682,257.

(51) Int. Cl.[7] ..... E02D 29/14
(52) U.S. Cl. ..... 404/25; 52/19; 52/20
(58) Field of Search ..... 404/25, 26; 52/19, 52/20, 21; 417/374, 425, 437, 461, 472, 481, 500, 395; 138/73

(56) References Cited

U.S. PATENT DOCUMENTS 4,523,407 A * 6/1985 Miller ..... 49/465
5,046,886 A * 9/1991 Muir et al. ..... 404/25
5,240,346 A * 8/1993 Yin ..... 404/25
5,275,501 A * 1/1994 Amorese et al. ..... 404/25
5,366,317 A * 11/1994 Solimar ..... 404/25
6,007,270 A * 12/1999 Bowman ..... 404/25

* cited by examiner

*Primary Examiner*—Thomas B. Will
*Assistant Examiner*—Raymond W Addie
(74) *Attorney, Agent, or Firm*—H. Gordon Shields

(57) ABSTRACT

Cover apparatus for temporarily covering access openings for water, drain, manhole and overflow pipes when the access openings are exposed, such as during construction, to prevent dirt, dust or unauthorized access to the access openings includes a top portion which extends outwardly beyond the access opening, an outer depending side wall which fits within the access opening, an outwardly flared lower side wall which extends below the outer depending side wall, a central cylindrical wall depending from the top portion in spaced relation from the depending side wall, and a plurality of ribs extending between the central wall and the depending side wall. A pump is secured within the central ring, and an expandable bladder in fluid communication with the pump is positioned on the depending side wall, between the top portion and the outwardly flared side wall. When inflated, the expandable bladder seals the cover apparatus to the access opening. In place of an expandible bladder, an elastomeric seal element is used, for small diameter access openings.

11 Claims, 10 Drawing Sheets

COVER APPARATUS FOR AN ACCESS PIPE OPENING

CROSS REFERENCE TO RELATED APPLICATION

This application is a Continuation In Part application of Ser. No. 10/091,511 filed Mar. 7, 2002 now U.S. Pat. No. 6,682,257.

BACKGROUND OF THE INVENTION

1. Field of the Invention

This invention relates to a cover apparatus for a manhole, pipe, or valve, and, more particularly, to a temporary cover for a manhole, pipe, or valve access opening utilizing a seal element that fits around the outer circumference of a depending side wall of the cover apparatus. The seal element provides a secure seal between the cover and the access opening. An externally flared side wall extends below the depending side wall to improve the seal between the seal element and the access opening by helping to restrain the seal element between the depending side wall and the access opening.

2. Description of the Prior Art

Water lines, sewer lines, and the like, and electrical wiring, etc., are typically buried under public rights of way, such as streets, alleys and easements. Access openings are spaced at intervals throughout the system of pipes. The access openings above normally open shut off valves are incorporated for the purpose of selectively isolating sections of the pipe in the event of a break or leak in the system.

The shut off valves are frequently buried several feet below the street. Access pipes or openings extend upwardly from the buried valves to the surface to provide a passage for a tool to selectively actuate the valve between its on and off positions. A mechanical cover assembly having a removable cover has traditionally been used to prevent debris from entering the access pipe. The cover assembly typically includes a cast iron cover with a mechanical locking apparatus to secure the cover to a concrete casting which supports the cover.

Drain and water lines are usually installed before the road or site grading begins. Manhole vault access openings to sewer systems are also placed in public rights of way, and are spaced at intervals throughout the system. Drainage gates are used to drain parking areas and other large surface areas. Drainage gates use slotted covers, and are also connected to the sewer system.

Municipalities usually bury their water and sewer main feeder pipes under public right of way, such as streets, alleys, and easements. Access opening elements are spaced at intervals throughout the pipe system. The access openings are used to isolate sections of the pipe in the event of a break or leak in the pipe system. Shutoff valves (not shown) are positioned adjacent to these access openings, to enable a worker to access a selected shutoff valve with a tool from the surface. Shutoff valves are typically installed several feet below ground. When these access openings are left uncovered, they tend to accumulate debris during the construction process, and pose a threat to people and vehicles in proximity to the access openings. Large flat steel plates (not shown) are sometimes used to cover access openings during construction. These plates are difficult to handle and position, and do not stop dirt, dust and other objects from entering the access opening beneath the steel plates, when the steel plates are not precisely aligned with the top of the access opening. Misaligned steel plates may form a safety hazard for vehicles passing over them, and do not stop vandals from removing the steel plates.

What is needed is a temporary cover that will easily conform to the rough and often unfinished top surface of the concrete manhole vault or on the top of a smaller diameter pipe which provides access to a shut off valve several feet below grade level. The temporary cover will stop dirt from being pushed into the sewer line or valve access pipe during grading or road construction, etc. Currently, large steel plates are placed over these manhole vaults, and are later removed when the final cast and ring setting work is complete. Steel plates provide a poor fit, and do not stop vandals from intruding into the pipes during construction.

INDUSTRIAL APPLICABILITY

The cover apparatus disclosed herein is applicable for covering various sizes of access openings, and is particularly useful for temporary use during construction of streets, sewers, and drains. The several embodiments of cover apparatus of the present invention disclosed herein are lightweight and adaptable for use on a variety of access openings as discussed.

Valve access covers are disclosed in the following prior art:

U.S. Pat. No. 6,109,822 issuing to Campbell et al, on Aug. 29, 2000 discloses a valve access cover assembly having an annular resilient flap.

U.S. Pat. No. 6,073,792 issuing to Campbell et al, on Jun. 13, 2000 discloses an access cap having a movable retaining tongue engageable with a portion of an access structure to retain the cap on the structure.

U.S. Pat. No. 5,439,130 issuing to Waugh on Aug. 8, 1995 discloses a debris cap with a locking post that is insertable into an opening in the closure of the cap.

U.S. Pat. No. 4,921,123 issuing to Mizioch on May 1, 1990 discloses a debris cap for closing the end of an access pipe for an underground water shut-off valve.

Pipe plugs are disclosed in the following prior art:

U.S. Pat. No. 6,289,935 issuing to Tash on Sep. 18, 2001 discloses a drainpipe test plug to seal a pressurized drainpipe.

U.S. Pat. No. 6,116,286 issuing to Hooper et al, on Sep. 12, 2000 discloses a pneumatic pipe plug for pipeline tee connections, having a molded cap structure. The air flow regulator extends above the cap, which makes the air flow regulator easy to vandalize.

Manhole covers are disclosed in the following prior art:

U.S. Pat. No. 6,199,414 issuing to Chang on Mar. 13, 2001 discloses a quick release lock for a manhole cover having a radially extended flange. This patent requires slots and catch elements mounted to the cover.

U.S. Pat. No. 5,987,824 issuing to Fuller on Nov. 23, 1999 discloses a locking manhole cover having pivotal locking elements hingedly attached to the frame, and movable locking members biases by interacting cam or gear arrangements.

U.S. Pat. No. 5,979,117 issuing to Fuller on Nov. 8, 1999 discloses a safety hole cover for drilled and augered holes, with retractable fingers which extend outwardly to engage the side wall of the hole. A tool is inserted through an aperture in the top cap to rotate the fingers.

U.S. Pat. No. 5,052,851 issuing to Frishauf on Oct. 1, 1991 discloses an emergency maintenance hole cover with an inflatable balloon having a cross-web and a valve extending above the hole.

These prior art patents do not solve the need for a temporary cover that win seal an unfinished opening during construction.

SUMMARY OF THE INVENTION

A cover apparatus for temporarily covering access openings for water, drain, manhole, and overflow pipes during construction, when the access openings are exposed, to prevent dirt, dust, or unauthorized access to the access openings. The cover apparatus includes a base cap element having an arcuate top portion which extends beyond the outer circumference of the access opening, a depending outer side wall and an outwardly flared lower side wall extending below the depending outer side wall, an inner or central cylindrical wall and a plurality of ribs extending between the central wall and the depending side wall. A pump is secured within the central ring, and an expandable bladder in fluid communication with the pump, or an elastomeric ring, is positioned about the outer depending side wall between the bottom of the cap portion and the outwardly flared side wall. When inflated, the expandable bladder expands to seal the cover apparatus to the access opening. A radially extending annular flange on the outer depending side wall may be used to position the expandable bladder on the outer depending side wall between the annular flange and the outwardly flared side wall for deeper penetration in the access opening. The inflatable or expandable bladder element may be either an air filled element or a liquid filled element. Either an air compressor or a hand pump may be used for the air filled element. A hand pump is included for the liquid filled bladder element. A deformable elastomeric sealing ring, essentially a large o-ring, is used in place of the bladder to seal the cover in the access opening in certain applications, such as relatively small diameter pipes or in "full size" pipes when no pump is wanted.

Among the objects of the present invention are the following:

- To provide a new and useful temporary cover for an access opening;
- To provide a new and useful manhole cover that is inexpensive, light weight, and easy to install and to remove;
- To provide an new and useful cover for an access opening that includes an inflatable bladder which expands to seal and retain the cover apparatus against an access opening for a manhole or a pipe;
- To provide new and useful temporary cover apparatus for an access opening having an outwardly inclined flange beneath an inflatable bladder to direct the bladder into a firm engagement with the access opening; and
- To provide new and useful cover apparatus including an elastomeric ring for sealing the cover apparatus in an access opening of a manhole or pipe.

These objects of the invention, together with the various features of novelty which characterize the invention, are pointed out in the claims. For a better understanding of this invention, its operating advantages and the specific objects attained by its users, reference should be made to the accompanying drawings and descriptive matter in which there is illustrated the preferred embodiments of this invention.

BRIEF DESCRIPTION OF THE DRAWING

The same reference numerals refer to the same parts in the various Figures.

DESCRIPTION OF THE PREFERRED EMBODIMENT

Figure 1:
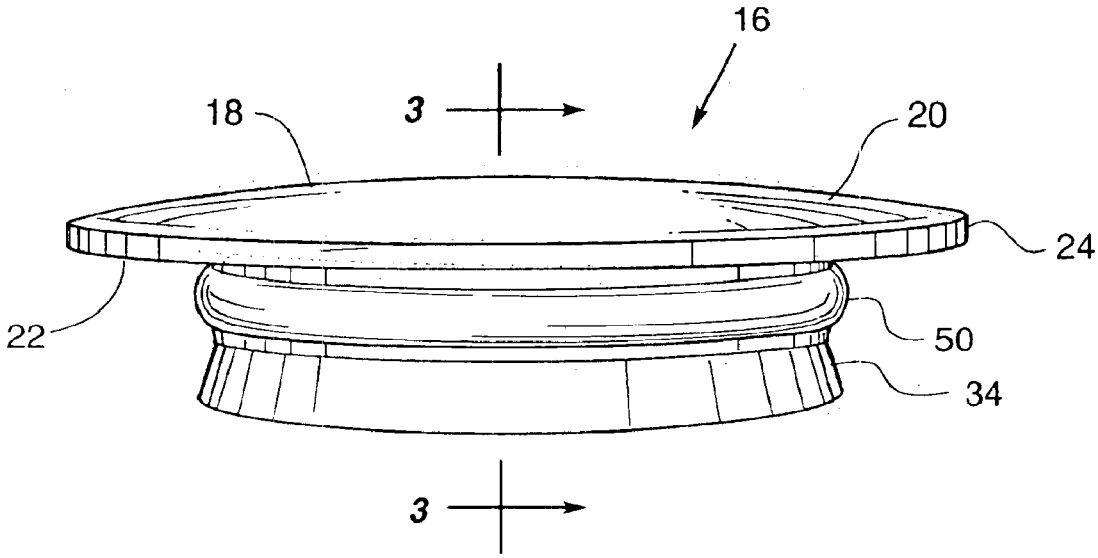
FIG. 1 is a side view of the cover apparatus of the present invention in its use environment.

For convenience, the term "pipe" maybe used relatively generically hereafter, and particularly in the claims, for all types of access opening elements, whether precast concrete pipe, pvc pipe, or other. And while concrete pipe is shown in some of the drawing Figures as the use environment or the present invention, it will be understood that pvc pipe or other appropriate types of pipe may also comprise the use environment for the apparatus of the present invention.

Figure 2:
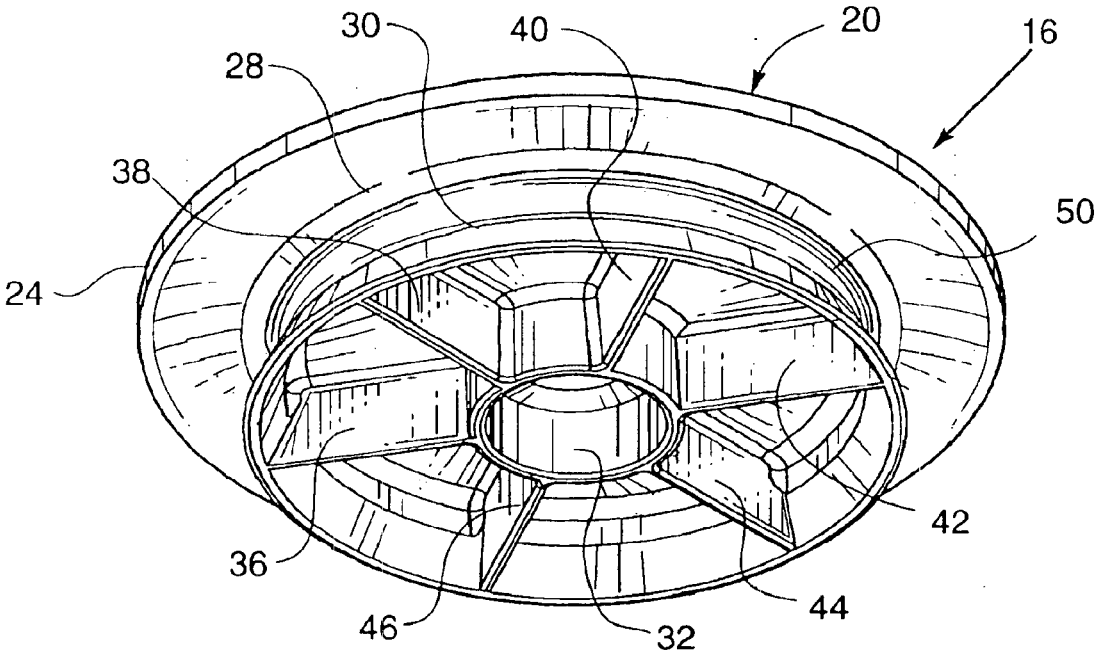
FIG. 2 is a bottom perspective view of a portion of the cover apparatus of FIG. 1.
Figure 3:
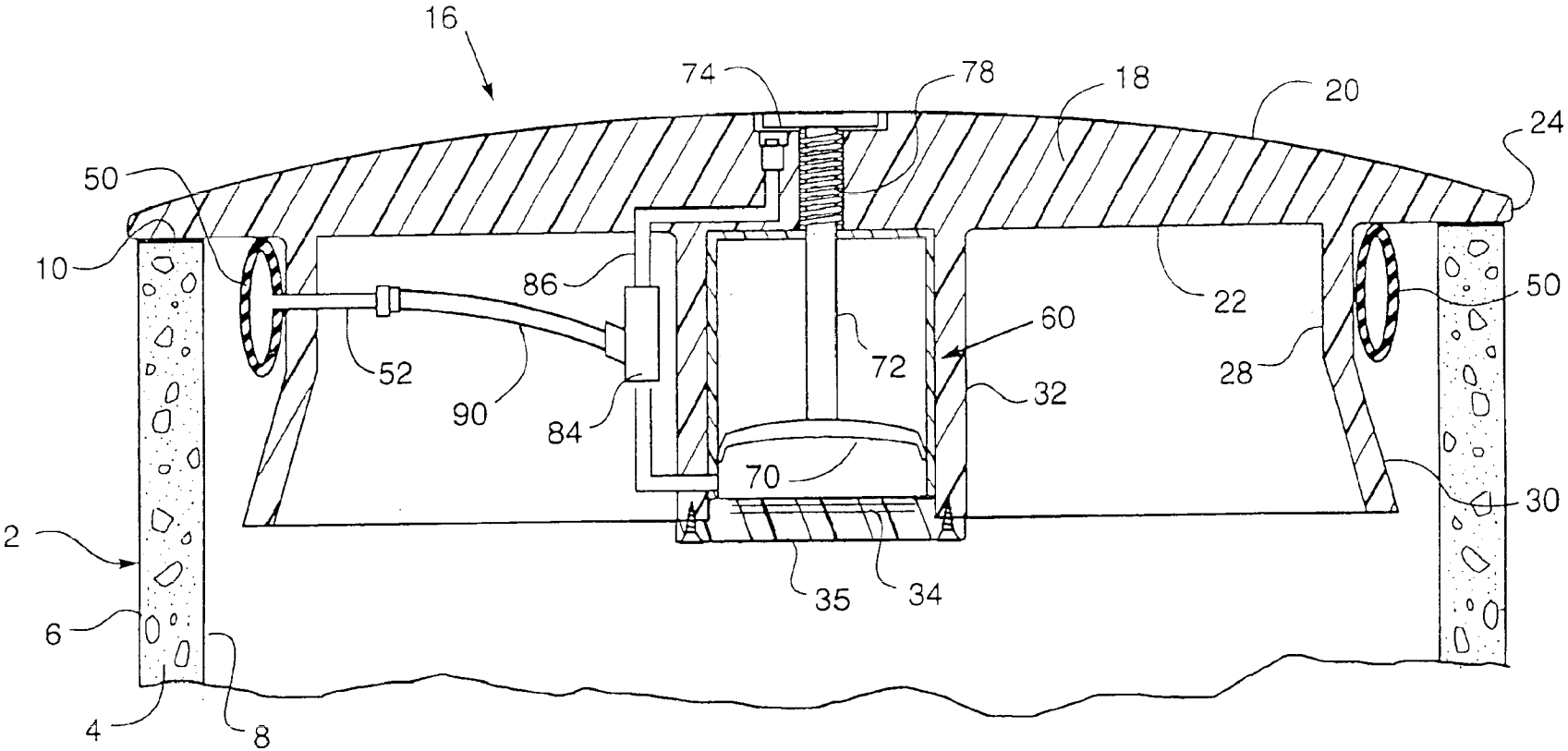
FIG. 3 is a view in partial section of the cover apparatus of the present invention taken generally along line 3—3 of FIG. 1.
Figure 5:
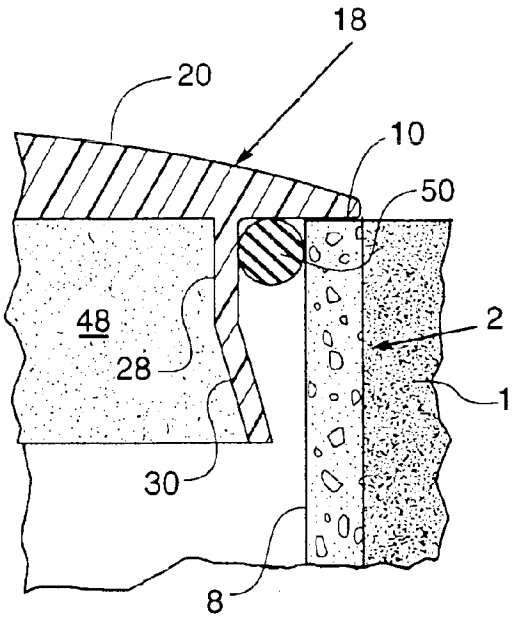
FIG. 5 is a fragmentary view of a portion of the apparatus of the present invention.
Figure 4:
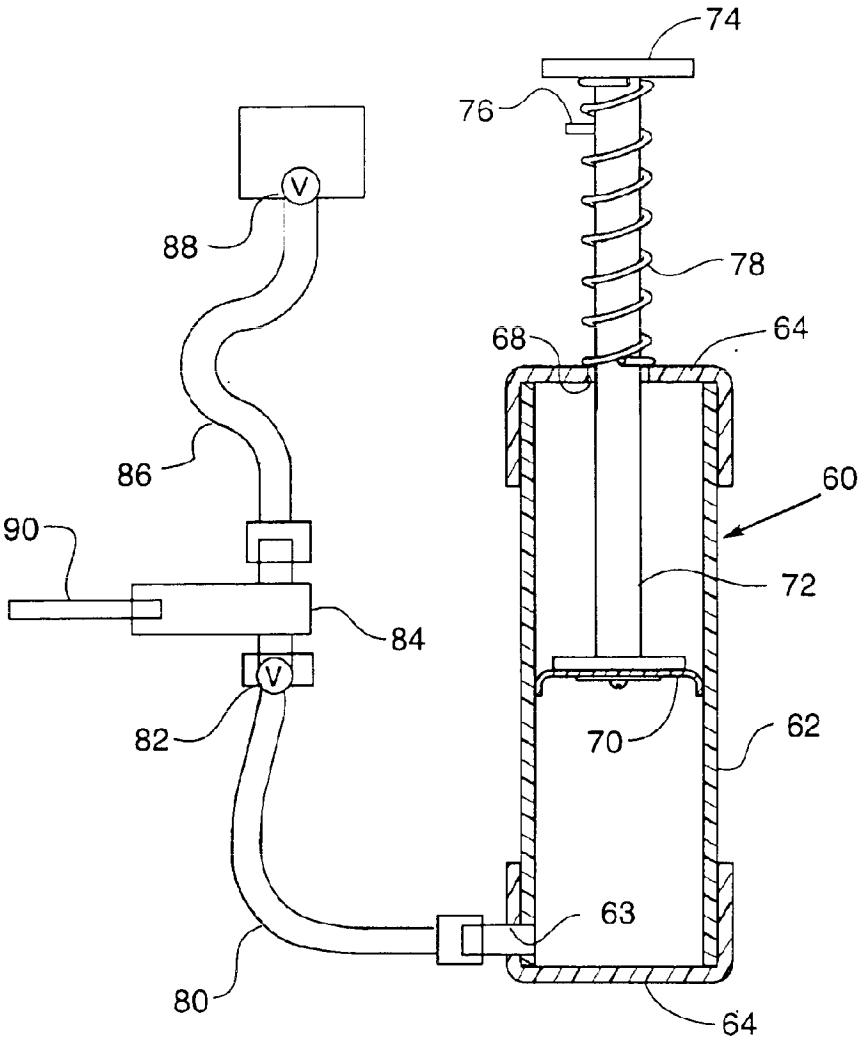
FIG. 4 is an enlarged schematic representation in partial section of a portion of the apparatus of FIG. 3.

FIG. 1 is a side view of a temporary cover apparatus 16 for an access opening for a manhole or pipe. FIG. 2 is a bottom perspective view of the cover apparatus 16. FIG. 3 is a view in partial section of the cover apparatus 16 in a precast vault access pipe 2, the opening of which comprises the use environment for or of the cover apparatus 16. FIG. 3 is taken generally along line 3—3 of FIG. 1. FIG. 4 is an enlarged schematic representation of a portion of the cover apparatus 16. FIG. 5 is a fragmentary view in partial section of a portion of the cover apparatus 16 in its use environment. For the following discussion, reference will be made to FIGS. 1, 2, 3, 4, and 5.

The cover apparatus 16 includes a base cap 18 having a domed top 20. The domed top configuration provides strength. The base cap includes a bottom 22 which is generally flat. The cap 18 includes an outer rim 24 at the juncture of the domed top 18 and the flat bottom 22. The domed top 18 thus extends outwardly to the outer rim 24 and is relatively thick, as opposed to a relatively thin outer rim. The entire cap has sufficient strength to withstand traffic as a normal situation.

Extending or depending downwardly from the bottom 22 is an outer cylindrical wall 28. The wall 28 is spaced inwardly from the rim 24. An outwardly and downwardly flaring or sloping wall portion 30 extends from the bottom of the wall 28. An inflatable or expandable bladder 50 is disposed about the wall 28 and above the sloping wall 30.

The cover apparatus 16 of the present invention is shown in FIG. 3 disposed on the pipe 2. The pipe 2 includes a wall 4, and the wall 4 has an external or outside circumference 6 and an internal or inside circumference 8. The pipe 2 also has a top rim 10. The pipe 2 defines an access opening. The access opening may be a manhole, or an opening for a valve for a water line, a drain line, or the like, as discussed above. A precast concrete pipe is typically used for a manhole, or the like, but for smaller openings, such as when an implement will extend downward to a shutoff valve, pvc pipe may be used instead of concrete pipe. This is well known and understood as discussed above.

The outer circumference of the rim 24 is greater than the outer circumference 6 of the pipe 2. The rim 22 is shown disposed on the top rim 10 of the pipe 2, and extends slightly beyond the outer diameter of the pipe. There is an opening extending through the top 20 which communicates with an inner cylindrical wall 32. Within the wall 32 is a pump 60. The inner cylindrical wall 32 defines a pump chamber for the pump 60. The cylindrical wall 32 is concentric with the wall 28 and extends downwardly from the bottom 22. The cap 18 has a central axis, and the wall 32 is disposed about the central axis. The cap 18 is disposed on the rim 10 in the use environment, as shown in FIG. 3.

Typically, the cap 18, and the cap elements of the other embodiments, as discussed below, may be made of glass filled polyester polyurethane. Other materials may be used, as desired or as appropriate. The glass filled polyester polyurethane is relatively inexpensive and light weight and is not difficult to mold into the desired configuration, with the desired elements molded in.

The cylindrical wall 28 extends downwardly from the bottom 22 of the top portion 20. The wall 28 has an outer circumference which is less than the inner circumference 8 of the access opening 2. The depending wall 28 extends downwardly from the bottom of the cap 18 and into the pipe 2 a relatively short distance. The wall 28 extends to the outwardly flared lower wall portion 30. The outer cylindrical wall 28 is sized or dimensioned to be substantially smaller than the inner circumference 8 of the access opening 2. This enables the depending wall 28 and the outwardly flared lower wall 30 to be slidably received within the inner circumference 8 of the access opening 2.

The inner cylindrical wall 32 depends downwardly from the bottom 22, in spaced relation about the central axis of the cap 18. The inner wall 32 is coaxially aligned with the opening through which a pump handle extends. The opening is sized to receive the pump handle therein. This will be discussed below.

The pump 60, shown in both FIGS. 3 and 4, is nested or disposed within the pump chamber defined by the inner cylindrical wall 32, as indicated above. The cylindrical wall 32 is closed at the bottom by a cover or bottom cap 34. Within the cover or bottom cap 34 is a locating coil 35. The purpose of the locating coil 35 is to enable the cover apparatus 16 to be located if it should be covered over during construction, which is not unlikely. Typical fasteners, such as screws or the like, may be used to secure the cap 34 to the cylinder 32.

As best shown in FIG. 2, a plurality of ribs 36, 38, 40, 42, 44, and 46 extend between the central cylinder 32 and the outer depending sidewall 28 and the outwardly flaring sidewall 30. While six ribs 42 . . . 52 are shown in FIG. 1, it is within the scope of this invention to provide from three ribs to sixteen ribs, as desired or as appropriate for a particular cover apparatus. Preferably, the space between the ribs 36 . . . 46 is filled with a structural foam 48, as shown in FIG. 5.

The cover apparatus 16 is preferably molded of a reinforced plastic material, as discussed above, which offers substantial weight reduction over the steel or cast iron covers in conventional use. The cover apparatus 16 disclosed herein is intended for use as a temporary cover for an access opening during road repair and construction, etc. The cover apparatus 16 is suitable for use with unfinished, as well as for use with finished, manholes or other pipes, etc.

Figure 11:
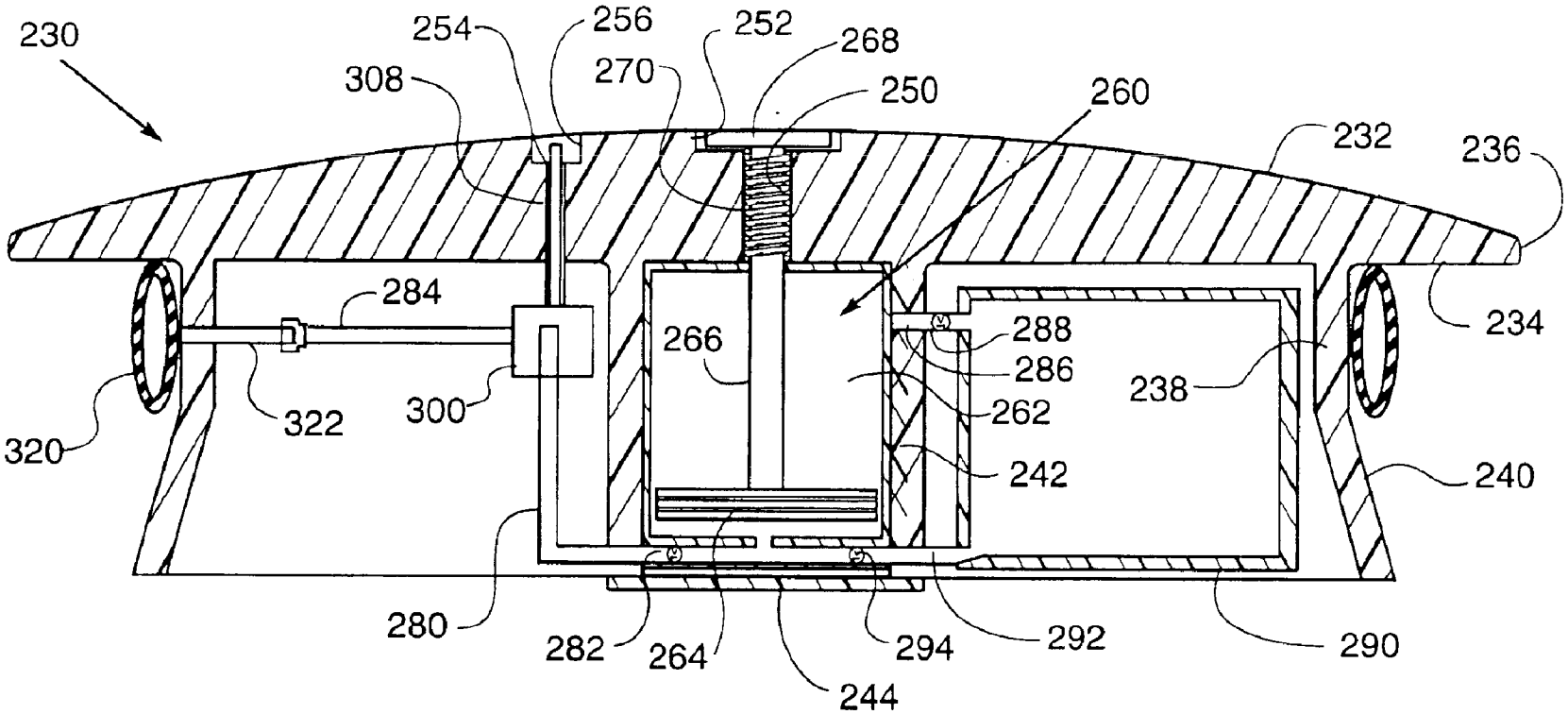
FIG. 11 is a view in partial section of another alternate embodiment of the present invention.
Figure 13:
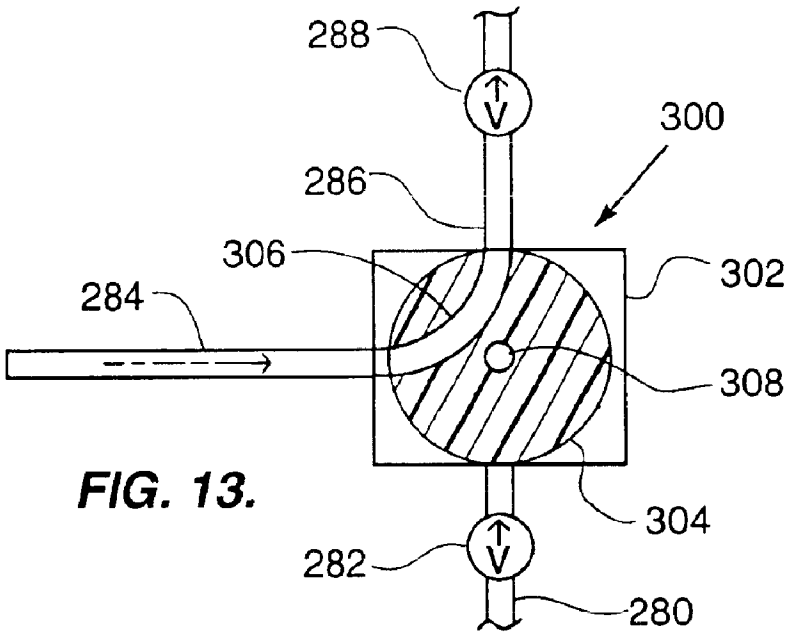
FIG. 13 is a schematic illustration sequentially following FIG. 12.
Figure 12:
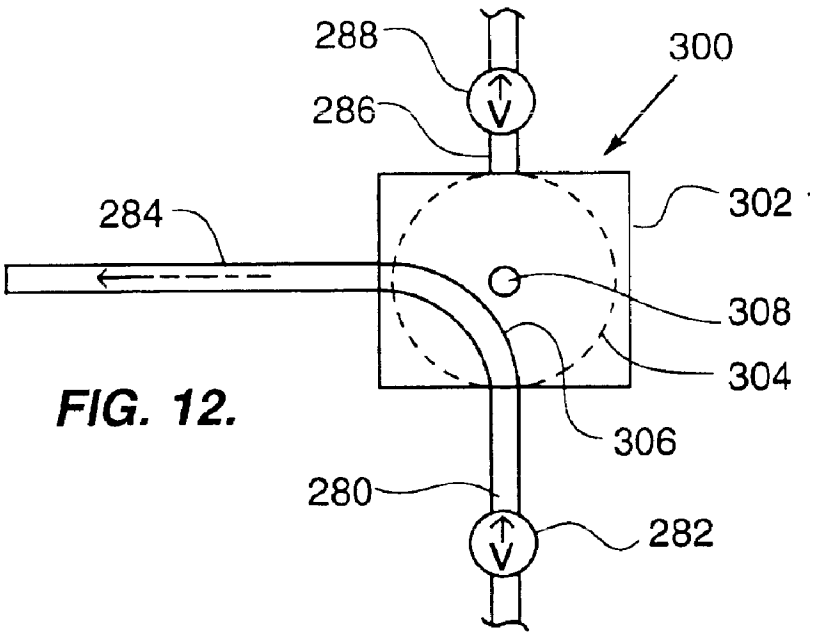
FIG. 12 is a schematic illustration of a portion of the apparatus of FIG. 11.

FIG. 3 is a side view in partial section of the cover apparatus 16, showing the expandable or inflatable element or bladder 50 installed about the outer circumference of the outer cylindrical wall 28. FIG. 5 is a fragmentary cross sectional view of a portion of the cover apparatus 18, showing the bladder 50 expanded to abut the access opening 2, thus sealing the access opening by the cover apparatus 16. The access opening 2 is shown illustratively in ground 1. The expandable bladder 50 is in fluid communication with the pump 60, as shown in FIGS. 3 and 4, so that when actuated, the pump 60 fills the expandable or inflatable bladder 50 with air. The bladder element 50 then exerts pressure against the interior wall 8 of the access opening 2 to form a seal between the access opening 2 and the outer circumference of the depending sidewall 28. The pump 60 may be manually, electrically, pneumatically, or hydraulically actuated, as appropriate. A hydraulic pump and associated elements are shown in FIGS. 11, 12, and 13, and will be discussed in detail in conjunction with those Figures.

The pump 60 is shown in FIG. 3 and also in FIG. 4. FIG. 4 is a schematic representation of the pump 60. For the following discussion, reference will be made primarily to FIGS. 3 and 4.

The pump 60 includes a cylinder 62, with a lower aperture 63 extending through the cylinder 62 for connecting the pump 60 to a conduit 80. The pump 60 also includes a bottom 64 and a top 66. An aperture 68 extends through the top 66 for receiving a rod 70. A piston 72 is appropriately secured to the bottom of the rod 70. The aperture 68 is oversized with respect to the diameter of the rod 70 to provide the easy flow of air to the interior of the cylinder 62 of the pump 60. Such is well known and understood, as is the action of the cup piston 70 in a pump.

Figure 6:
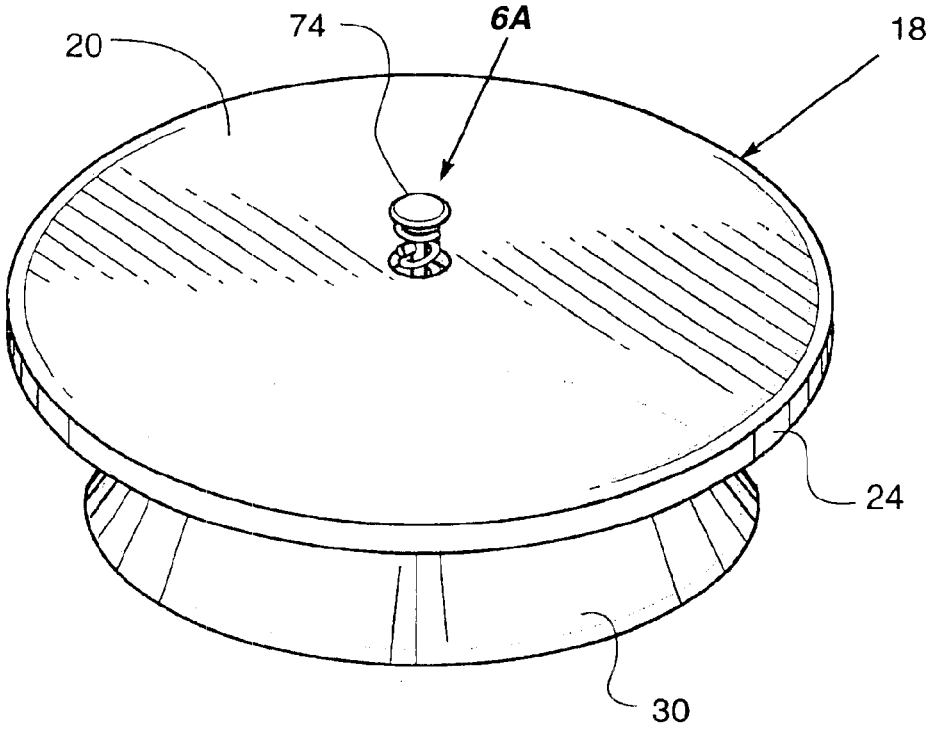
FIG. 6 is a top perspective view of the cover apparatus of the present invention.
Figure 6A:
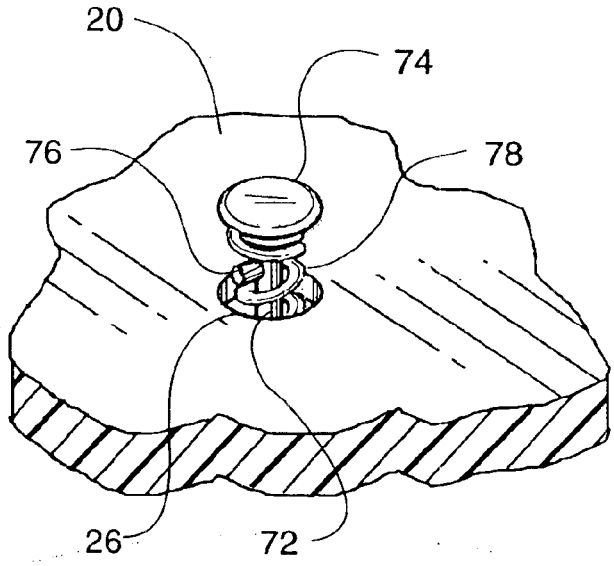
FIG. 6A is an enlarged perspective view of a portion of FIG. 6.

A handle 76 is secured to the top of the rod 72. Below the handle 76 is a bayonet pin 76. The pin 76 extends radially outwardly from the handle for locking the rod 72 downwardly in the cylinder 60. The cover apparatus includes a molded recess to receive the bayonet pin 76. Details of the handle 76 and related elements are also shown in FIGS. 6 and 6A and discussed below in conjunction with those Figs.

Disposed about the rod 72 and extending between the top 64 and the handle 74 is a compression spring 78. The spring 78 biases the handle 74, and accordingly the rod 72 and piston 70, upwardly.

The cylindrical wall 32 is dimensioned to receive the pump 60. An aperture in the lower portion of the wall 32 provides communication between the pump 60 and the exterior of the wall 32 for the conduit 80 and its associated elements. The conduit 80 extends to a one way valve 82. The valve 82 is disposed adjacent to a tee element 84. From the tee element 84 a conduit 90 extends to a valve stem 52 of the bladder 50. The valve 82 allows the pressurized air to flow from the pump 60, but prevents the air from flowing back into the pump.

Also connected to the tee element 84 is a conduit 86 which extends to a valve 88. The valve 88 is disposed in the cap 18 at the dome 20 adjacent to the handle 74. The valve 88 is a Schrader type, or a tire type, which admits pressurized air which biases a valve stem downwardly to admit the air and, when the valve stem is depressed, allows the pressurized air to escape or flow outwardly. The valve 88 is thus used to pressurize the bladder 50 when an external source of compressed air is used, in place of the pump 60, and is used to deflate the bladder 50 in order to remove the cover apparatus from an access opening. Typically, the bladder is inflated with fifteen to twenty psi, whether the inflation is by a manual pump, such as the pump 60, or by a compressor, etc. Due to the temperature differential between day and night, the pressure decreases to about ten psi. The ten psi minimum assumes that the original pressure is about twenty psi by noon. The ten psi is about the minimum needed to provide a satisfactory seal between the cover apparatus and an access opening.

In FIG. 2, the bladder 50 is shown in its unpressurized (deflated) form or condition, as it is when the cover apparatus 16 is initially installed in an access opening, such as in the precast concrete access pipe 2. In FIG. 5, the bladder 50 is shown expanded by compressed air. The bladder 50 is now disposed between the wall 28 and the interior portion 8 of the pipe 2 to secure the apparatus 16 to the pipe 2. Ground 1 is also shown in FIG. 5. FIG. 5 is a fragmentary view in partial section showing a portion of the pipe 2 in the ground 1, with the cover apparatus 18 secured to the pipe 2 by the expanded bladder 50.

Also shown in FIG. 5 is structural foam 48 disposed between the cylindrical wall 32 (see FIG. 3) and the wall 28 and its depending wall 30. The wall 30 helps to hold the bladder 50 in place, as mentioned above.

FIG. 6 is a top perspective view of the cover apparatus 16, showing the handle 74 above a central aperture 26 on the dome top 20. FIG. 6A is an enlarged perspective view of a portion of FIG. 6.

The handle 74 is secured to the rod 72, and the handle 74 is biased be the compression spring 78. The locking bayonet pin 76 is shown extending outwardly from the rod 72. Not shown in FIG. 6 is the bladder 50 above the outwardly flaring wall portion 34.

Figure 7:
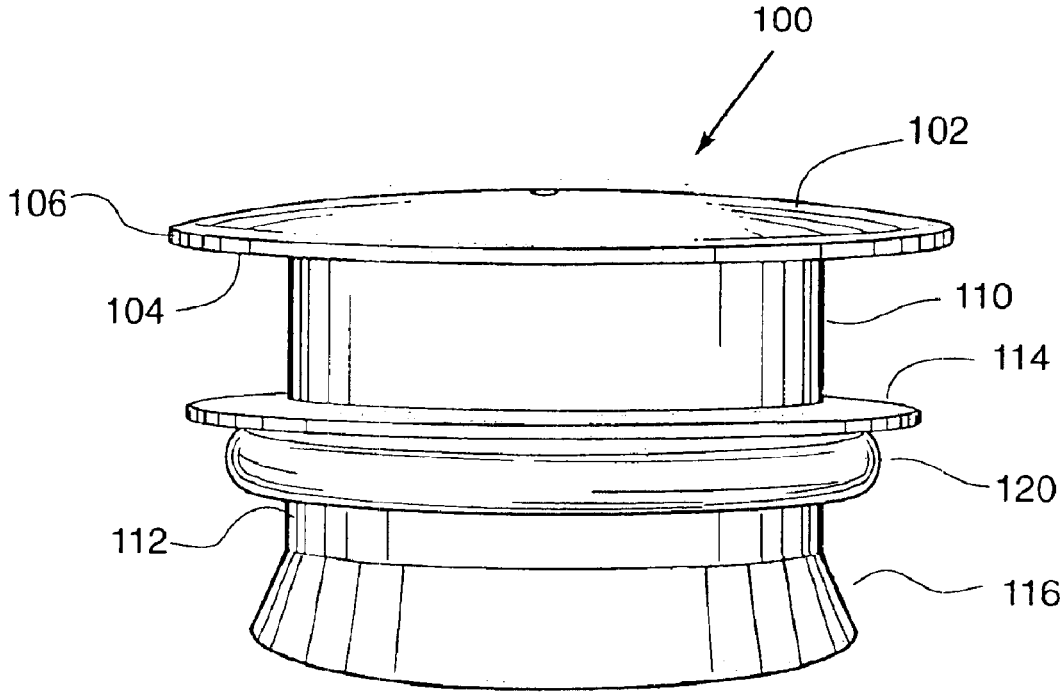
FIG. 7 is a side perspective view of the apparatus of the present invention with an added element defining an alternate embodiment.
Figure 8:
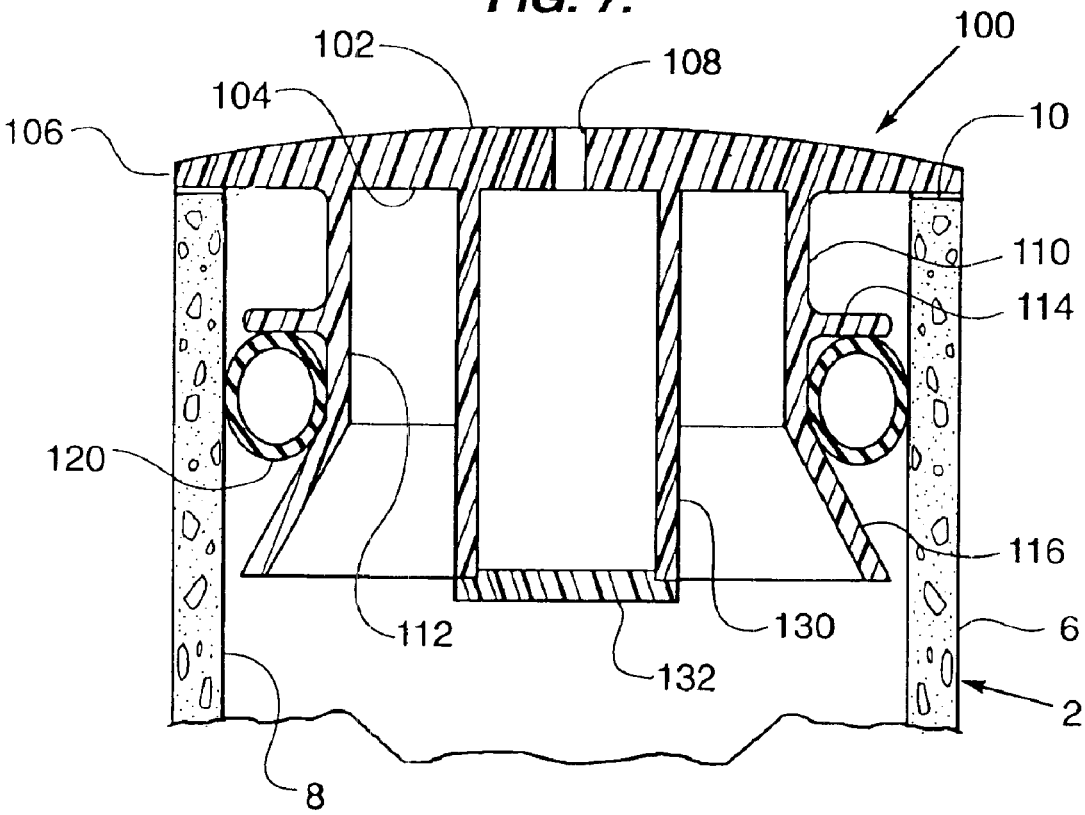
FIG. 8 is a cross sectional view of the cover apparatus shown in FIG. 6 its use environment, and taken generally along line 8—8 of FIG. 7.

FIG. 7 is a front view of an alternate embodiment 100 of the cover apparatus 18. FIG. 8 is a view in partial section of the cover apparatus 100 taken generally along line 8—8 of FIG. 7, and shows the cover apparatus in its use environment, namely the pipe 2. For the following discussion, reference will primarily be made to FIGS. 7 and 8.

The cover apparatus 100 is substantially the same as the apparatus 16 with a primary difference being an added radially outwardly extending wall or flange 114 and elongated cylindrical walls to elongate the vertical length or height of the apparatus 100 to allow a bladder 120 of the apparatus 100 to be disposed lower in an access opening or pipe, such as the pipe 2.

The cover apparatus 100 includes a dome shaped top 102 and a generally flat bottom 104. The juncture of the top 102 and the bottom 104 defines an outer rim 106. Extending downwardly from the bottom 104 is an outer cylindrical wall which is divided into two portions, an upper portion 110 and a lower portion 112 by the radially outwardly extending wall or flange 114. An outwardly and downwardly flaring wall 116 extends from the bottom of the wall portion 112. The bladder 120 is disposed about the wall portion 112 beneath the flange 114 and above the flaring wall 116.

An inner cylindrical wall 130 extends downwardly from the bottom 104 coaxially aligned with a central opening 108 which extends through the cover between the top 102 and the bottom 104. The opening 108 receives the handle of a pump, not shown, disposed in the cylindrical wall 130. The wall 130 is closed by a bottom cap 132. The cap 132 includes, of course, a locating coil, just as is included in the bottom cap 34 of the apparatus 18. The wall 130 defines a pump chamber.

The cover apparatus 100, like the apparatus 18, preferably molded of glass filled polyester polyurethane, but may be made of other appropriate materials, as desired. The space between the central cylindrical wall 130 and the outer wall portions 110, 112, and 116 is preferably filled with a foam product, not shown, just as with the cover apparatus 18.

Figure 9:
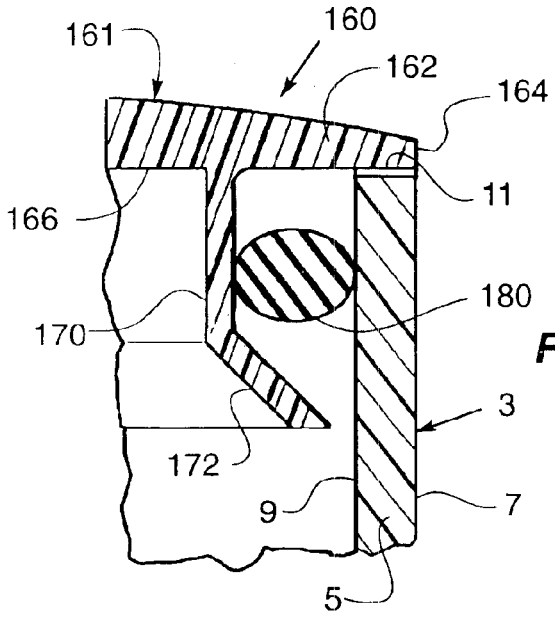
FIG. 9 is a fragmentary view of another alternate embodiment of the present invention.

FIG. 9 is a fragmentary view in partial section of another alternate embodiment 160 of the cover apparatus of the present invention. The apparatus 160 is used for sealing relatively small diameter access openings, such as for valve access, when the interior or inside diameter of the access pipe is about six inches or eight inches. In such case, the apparatus 16 or the apparatus 100, with their inflatable or expandible bladders are not required. Rather, an elastomeric ring seal element 180 is used in place of the expandible bladder 50 or 120. The ring 180 is deformable to provide the desired seal with a pipe access opening.

The cover apparatus 160 includes a base top 161 which has a domed top portion 162 extending to an outer rim 164 and a generally flat bottom 166. The bottom 166 is shown disposed on a top rim 10 of a pipe 3. The pipe 3 is, of course, the use environment of the cap apparatus 160.

As indicated above, pvc pipe is typically used for access openings for valves, when only a valve actuation tool rather than a person, will be used. Thus, for access opening pipes of six or eight inch inside diameters, such as the pipe 3, a deformable elastomeric ring seal element may be used. The pipe 3 comprises a wall 5 having an outer wall portion 7 and in inner wall portion 9 and the top rim 11. The base cap 161 of the cover apparatus 160 is disposed on the top rim 11 of the pipe 3.

The cap 161 also includes an outer cylindrical wall 170 and a lower, outwardly flaring wall 172 extends from the bottom or lower portion of the wall 170. The wall 172 terminates inwardly from the outer rim 164 and inwardly from the inner wall 8 of the pipe 2. Without a bladder, there is no need for an inner cylindrical wall and the ribs which extend outwardly from the inner cylindrical wall to the outer cylindrical wall in the previous embodiments. However, the lower outwardly and downwardly flaring or extending wall 172 is used to help retain the elastomeric ring element 180 in place.

The elastomeric ring 180 is disposed about the outer cylindrical wall 170 and above the downwardly and outwardly flaring wall 172. The ring 180 is deformable, and accordingly provides a seal between the interior wall portion 9 and the wall 170. The diameter of the seal 180 in its undeformed state is greater than the interior diameter of the wall 9, thus providing the appropriate and intended seal when deformed in place. There is a press fit of the apparatus 160 into the access opening 8. In FIG. 9, the seal element 180 is shown slightly deformed after the apparatus 160 is press fitted against the interior or inside wall 9 of the pipe 3.

Figure 10:
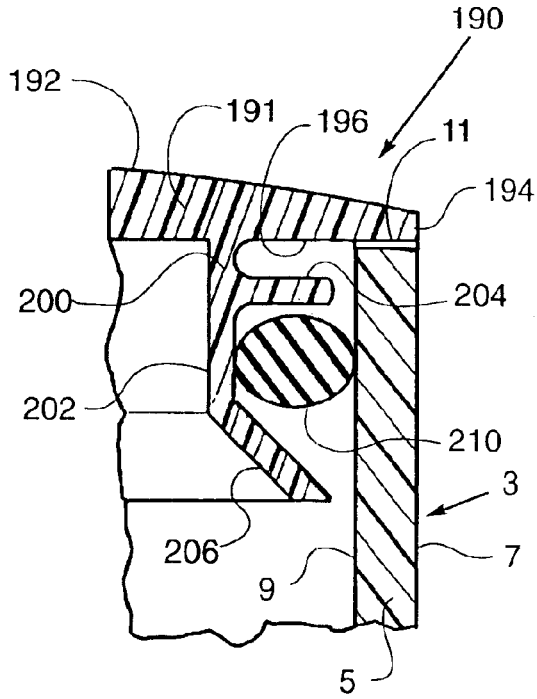
FIG. 10 is a fragmentary view of another alternate embodiment of the present invention.

FIG. 10 is a fragmentary view in partial section of another alternate embodiment 190 of the apparatus of the present invention, namely an alternate embodiment of the cover apparatus 100 of FIGS. 7 and 8. The cover apparatus 190 is substantially the same as the cover apparatus 160 with a deformable elastomeric ring seal element 210 used in place of the expandible bladder 120 of the apparatus 100. The elastomeric ring element 210 is substantially identical to the element 180 of the apparatus 160 of FIG. 9. The cover apparatus 190 is also shown in it use environment, namely the pipe 3.

The apparatus 190 includes a base cap 191 having a dome shaped top 192, which extends to an outer rim 194, and a generally flat bottom 196. The bottom 196 of the apparatus 190 is disposed in the top rim 11 of the pipe 3, adjacent to the rim 194.

The cover apparatus 190 also includes an outer cylindrical wall divided into two portions, an upper portion 200 and a lower portion 202, by a radially outwardly flaring wall or flange 204. A lower wall 206 extends or flares downwardly and outwardly from the lower wall portion 202. The deformable elastomeric ring seal element 210 is disposed about the wall portion 202 between the radial wall 204 and the outwardly and downwardly extending or flaring wall 206. Once again, an inner cylindrical wall and the ribs extending from the inner wall to the outer wall, as in the embodiment of FIG. 9, are not present.

The seal element 210, as indicated above, is substantially identical to the seal element 180 in purpose and function and composition. The seal elements 180 and 210 are essentially relatively large o-rings. The apparatus 190 functions the same as the apparatus 160 in installation and use. The apparatus 190, being longer than the apparatus 160, may be employed where its longer length is advantageous. As with the cover apparatus 160, a press fit is used to insert the cover apparatus 190 into the relatively small diameter pipe 3. And again, as in FIG. 9, the seal element is shown deformed in the press fit with the pipe 3.

FIG. 11 is a view in partial section of another alternate embodiment of the apparatus of the present invention, namely a cover apparatus 230 which uses a liquid pump to expand an expandible bladder 320 rather than pneumatic (compressed air) pressure to expand the bladders illustrated above in conjunction with the embodiments of FIGS. 1, 2, 3, 4, 5, and 6. FIGS. 12 and 13 are enlarged schematic representations of a portion of the hydraulic system of the apparatus 230 illustrating the valving for expanding and deflating the expandible bladder 320. For the following discussion, reference will be made primarily to FIG. 11, with valving details discussed in conjunction with FIGS. 12 and 13.

The cover apparatus 230 has substantially the same general configuration as the previous embodiments, differing only in the use of a hydraulic pump 260 and its associated elements, and accordingly differing slightly in structure to accommodate the various elements. The cover apparatus 230 includes a generally dome shaped top 232 and a generally flat bottom 234. The top 232 extends to an outer rim 236. An outer cylindrical element or wall 238 extends downwardly from the bottom 234 inwardly from the rim 236. The wall 238 terminates in an outwardly and downwardly flaring wall portion 240. The bladder 320 is disposed about the wall 238 above the wall 240.

An inner cylindrical wall 242 is concentrically disposed with respect to the dome 232. The wall 242 defines a pump chamber for receiving a pump. Within the wall 262 is a hydraulic pump 260. The cylindrical wall 242 is closed by a bottom cap 244. The bottom cap 244 includes a locating coil, as do the prior embodiments as discussed above. Extending along a central axis of, and through, the cover apparatus 230 is a bore 250. The bore 250 receives a pump rod 266. An actuator recess 252 at the upper end of the bore 250 receives a pump handle 268 which is secured to the rod 266.

Spaced apart from the bore 250 and its recess 252 is another bore 254 and a recess 256. The bore 252 extends through the cover between the dome top 232 and the bottom 234 and offset from the central cylindrical wall 242. An actuator rod 254 for a valve 300 extends through the bore 254. A hex head 256 on the rod 254 is disposed in the recess 256. The recess 256 is essentially an enlarged portion of the bore 254 for receiving a socket to actuate a ball valve 300. This will be discussed below in detail in conjunction with FIGS. 12 and 13.

The pump 260 includes a cylinder housing 262, which includes a cylinder in which is disposed a piston 264, a housing bottom and a housing top. The housing top includes an aperture through which the rod 266 extends. A compression spring 270 extends between the top of the cylinder housing and the bottom of the handle 268. The rod 266 includes a locking bayonet pin (not shown), just as does the pump rod 72 for the pneumatic pump discussed in detail above, and there is a recess (not shown) for receiving the pin for locking the handle 268 in the recess 252.

A conduit 280 extends from the bottom of the cylinder 262 and through an aperture in the wall 242 to the valve 300. A one way valve 282 in the conduit 280 allows liquid flow from the pump 260 to the valve 300, and prevents fluid from flowing back to the pump.

A fluid reservoir 290 is disposed between the wall 238 and the wall 242. A conduit 286 extends from the valve 300 to the top or upper portion of the reservoir 290. A one way valve 288 is disposed in the conduit 286 to permit fluid flow from the valve 300 only to the reservoir 290 and to prevent fluid flow from the reservoir 290 to the valve 300. A conduit 292 extends from the lower portion of the reservoir 290 to the lower portion of the cylinder 262. A one way valve 294 is disposed in the conduit 292 to allow only fluid flow from the reservoir 290 to the cylinder 262 and to prevent fluid flow from the cylinder 262 to the reservoir 290.

The valve 300 is, as mentioned above, a ball valve which includes a ball 304 disposed in a housing 302. The working of the valve 300 is shown in detail in FIGS. 12 and 13. FIG. 12 illustrates the valve setting for inflating or expanding the bladder 320, and FIG. 13 illustrates the valving for deflating the bladder 320. Attention should also be give to FIG. 11 while reviewing FIGS. 12 and 13.

The actuator 308 is secured to the ball 304 and rotates the ball ninety degrees to connect a conduit 306 in the ball with either the conduit 280 from the pump 260 to a conduit 284 to expand the bladder 230, or to connect the conduit 284 with the conduit 286. The conduit 284 extends from the valve 300 to a stem 322 of the bladder 320. The conduit 286 allows the fluid to flow from the bladder 230 back to the reservoir 290 to deflate the bladder 320.

Water may be used as the liquid for the cover apparatus 230. Where the freezing of water is a possibility, an antifreeze solution may be added. As an alternative, any environmentally safe oil may also be used.

Figure 14:
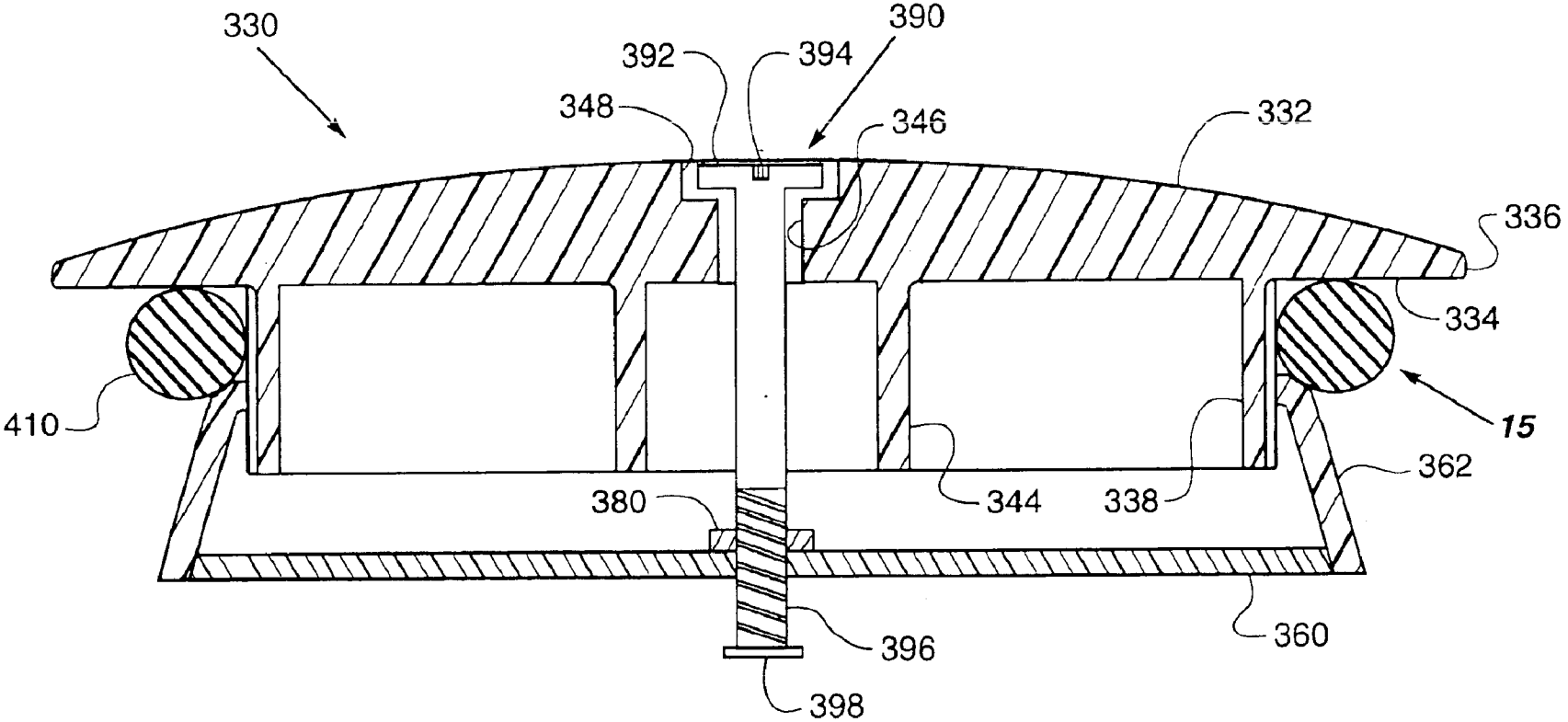
FIG. 14 is a view in partial section schematically illustrating another alternate embodiment of the present invention.
Figure 15:
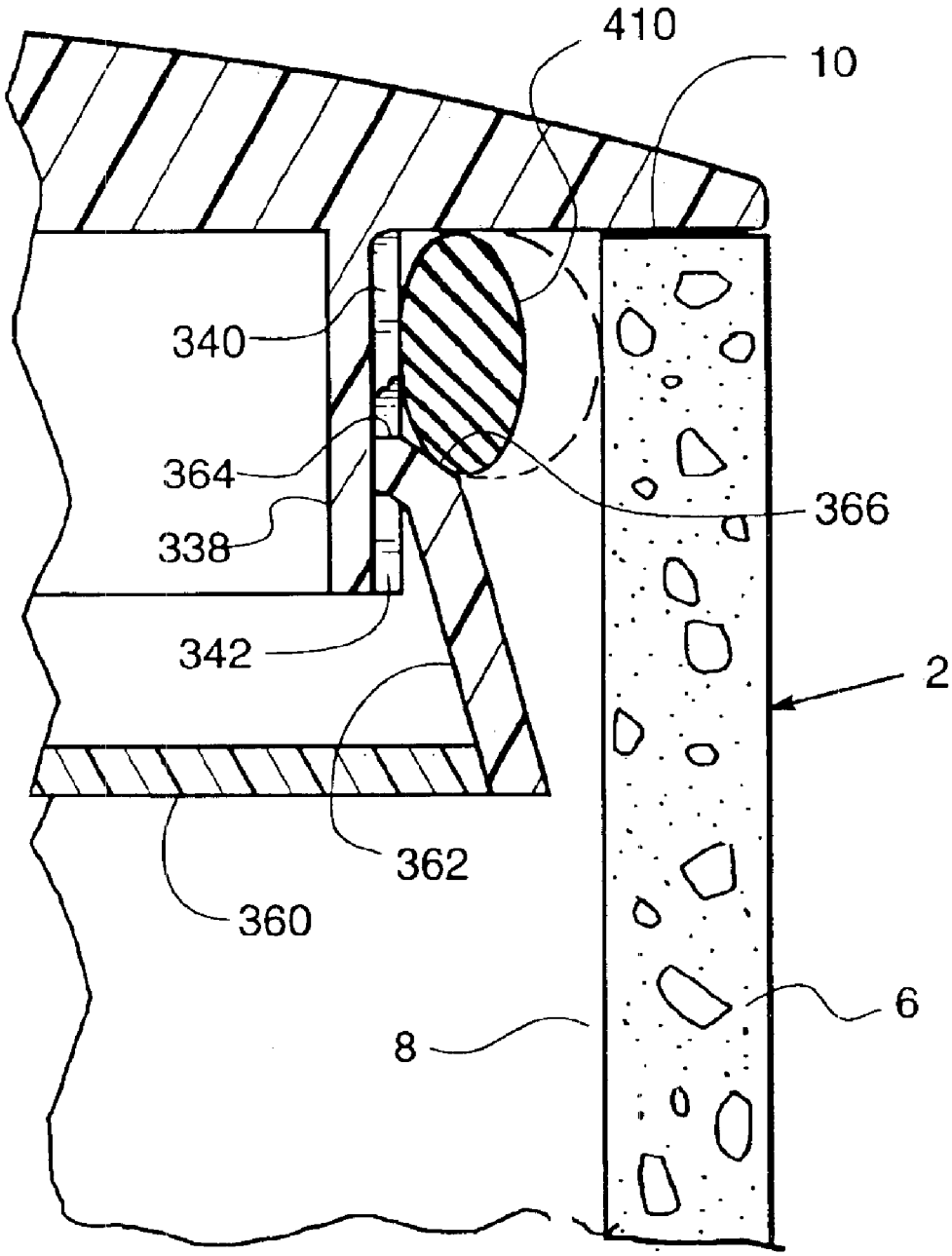
FIG. 15 is an enlarged view of a portion of the apparatus of FIG. 14.

FIG. 14 is a view in partial section of another alternate embodiment of the apparatus of the present invention, comprising cover apparatus 330 which includes a manually actuated or deformed elastomeric seal element 410 disposed about an outer cylindrical wall 338. FIG. 15 is an enlarged view in partial section of a portion of the apparatus 330. For the following discussion, reference will be made to both FIGS. 14 and 15.

The cover apparatus 330 has the general configuration of the other cover apparatus embodiments discussed above, namely a dome shaped top 332 and a generally flat bottom 334. The top 332 extends to an outer rim 336. Inwardly from the rim 332 is an outer cylindrical wall 338. The outer cylindrical wall 338 includes a plurality of pairs of guide rails 340 and 342, shown in FIG. 15. The guide rail pairs will be discussed in detail below.

Concentrically disposed with respect to the cover apparatus 330 and to the wall 338 is an inner cylindrical wall 344. Centered on the cover apparatus 330 is a bore 346 which extends between the domed top 332 and the bottom 334. At the top of the bore 346 is a cap recess 348.

A base 360 is disposed beneath the cylindrical walls 338 and 344. The base 360 includes a cam element 362 which extends upwardly and inwardly from the outer periphery of the base. The base 360 is essentially a circular disk which moves vertically upwardly and downwardly in response to rotation of a threaded rod. A nut 380 is secured to the center of the base 360.

The cam element 362 includes a plurality of guide tips 364 which are disposed in the guide rails 340, 342 to guide the cam element 362 upwardly and downwardly. The guide tips 364 extend inwardly from inside of the cam element and are spaced apart to help guide the cam element 362 upwardly and downwardly smoothly. The guide tips 364 extend inwardly from the inner periphery of the cam element 362. The guide tips 364 extend into the guide rail pairs 340, 342. The guide rail pairs 340, 342 and the guide tips 364 comprise spaced apart guide elements for the apparatus 330.

The upper outer periphery of the cam element 362 includes a chamfered cam edge 366. The upward movement of the base 360 causes the cam element 362 to move upwardly, with the edge 366 disposed against a deformable elastomeric seal element 410. Again, the deformable elastomeric seal element 410 is essentially an o-ring. The continued upward movement of the base causes the element 410 to deform upwardly and outwardly to provide a seal between the wall 338 and the interior surface 8 of the access pipe 2, as shown in FIG. 15 in dashed line.

Downward movement of the base 360 allows the seal element 410 to return to its undeformed condition to break the seal and accordingly to allow the cover apparatus 330 to be removed from the pipe 2.

Movement of the base 360 is accomplished be rotation of a threaded rod 390. The rod 390 includes an actuator top cap 392. The cap 392 preferably includes a hex recess 394 for receiving a wrench to rotate the rod 390. In the alternative, the cap 390 may be hex shaped to receive a socket for rotating the rod 390. The rod 390 includes a threaded lower portion 396 which extends through the fixed threaded nut 380 and through an aligned aperture in the base 360. A bottom retaining cap 398 limits the downward movement of the base 360 by limiting the rotation of the rod 390 in one direction.

The plurality of pairs of guide rails 340, 342 help to guide the base, with its cam element 362 upwardly and downwardly. The pairs of guide rails 340, 342 are appropriately spaced apart on the wall 338, as mentioned above. The guide rails 340, 342, with the guide tips 364, also prevent the rotation of the base 360, allowing only straight line vertical movement up and down for deforming and relaxing the elastomeric seal element 410.

Each of the various embodiments of the cover apparatus of the present invention may have a particular applicability, depending on the size (diameter) of the access opening for which a cover apparatus is desired, and the type of material out of which the access opening is made, whether concrete, pvc pipe, or other. As indicated above, an access opening may be quite small, as when access is provided for a valve, or several valves, or when access is provided by a manhole, large enough to admit a person with required equipment. Typically, manholes, or manhole pipes, as they may be referred to, have an inner diameter of twenty seven or thirty inches, and valve access pipes typically have an inner diameter of six or eight inches. The outer cylindrical walls have an outer diameter considerably less than that of the pipe for which a cover apparatus is designed. This provides sufficient clearance so that the outwardly and downwardly flaring or extending wall may have a diameter less than that of the pipe. This insures that there is no problem in inserting a cover apparatus into an access opening of a pipe without damage to the bladder or elastomeric element. However, as indicated above, for the cover embodiments of FIGS. 9 and 10, for small diameter access opening pipes, the elastomeric rings have a press fit into the access opening, and the outer diameter of the elastomeric rings in their undeformed state or condition is slightly larger than the inner diameter of the pipe into which a cover is inserted.

While the principles of the invention have been made clear in illustrative embodiments, without departing from those principles there may occur to those skilled in the art modifications of structure, arrangement, proportions, the elements, materials, and components used in the practice of the invention, and otherwise, which are particularly adapted to specific environments and operative requirements. The appended claims are intended to cover and embrace any and all such modifications within the limits only of the true spirit and scope of the invention.

What is claimed is:

1. Temporary cover apparatus for an access opening pipe comprising in combination:

a base cap;

an outer cylindrical wall extending downwardly from the base cap;

a seal element comprising an expandible bladder disposed about the outer cylindrical wall to provide a seal between the temporary cover apparatus and the access opening pipe;

an inner cylindrical wall extending downwardly from the base cap; and pump means disposed in the inner cylindrical wall for expanding the expandible bladder.

2. The apparatus of claim 1 which further comprises a downwardly and outwardly flaring wall extending downwardly and outwardly from the outer cylindrical wall; and the seal element is disposed about the outer cylindrical wall and above the downwardly and outwardly flaring wall.

3. The apparatus of claim 1 in which the pump comprises an air pump.

4. The apparatus of claim 1 in which the pump comprises a liquid pump.

5. The apparatus of claim 2 which further includes a radially outwardly extending cylindrical wall dividing the outer cylindrical wall into an upper portion and a lower portion, and the seal element is disposed about the lower portion of the outer cylindrical wall.

6. The apparatus of claim 2 in which the base cap includes a domed top, a generally flat bottom, and an outer rim which extends over the access opening pipe.

7. The apparatus of claim 1 which further includes a bore extending axially through the base cap, and an inner cylindrical wall extending downwardly from the base cap and concentric with the outer cylindrical wall.

8. The apparatus of claim 7 which further includes an outwardly and downwardly flaring wall extending from the outer cylindrical wall.

9. The apparatus of claim 7 in which the pump means includes a rod extending through the bore in the base cap.

10. The apparatus of claim 7 which further includes a plurality of ribs extending between the inner cylindrical wall and the outer cylindrical wall.

11. The apparatus of claim 10 which further includes foam disposed between the plurality of ribs and the inner and outer cylindrical walls.

* * * * *